US005174469A

United States Patent [19]

Policapelli

[11] Patent Number: 5,174,469

[45] Date of Patent: Dec. 29, 1992

[54] PARTIALLY COLLAPSIBLE CONTAINER WITH DRINKING STRAW OR POUR SPOUT

[76] Inventor: Nini E. Policapelli, 361 North Robertson Blvd., Los Angeles, Calif. 90048

[21] Appl. No.: 614,079

[22] Filed: Nov. 13, 1990

[51] Int. Cl.[5] ..... B65D 25/40

[52] U.S. Cl. ..... 220/710; 220/265; 220/666; 220/667; 220/672; 220/674; 220/675; 222/81; 222/464; 222/541; 229/103.1

[58] Field of Search ..... 220/90.2, 90.6, 906, 220/907, 666, 667, 672, 265, 674, 669, 675, 266, 270, 670, 671, 673, 705, 709, 110; 229/103.1; 222/80, 81, 82, 83, 92, 211, 464, 541

[56] References Cited

U.S. PATENT DOCUMENTS

| | | | |
|---|---|---|---|
| 2,139,143 | 12/1938 | Wiswell | 220/907 X |
| 2,563,352 | 8/1951 | Morse | 206/519 X |
| 3,194,468 | 7/1965 | Baron | 220/675 X |
| 3,236,697 | 2/1966 | Amiet et al. | 222/81 X |
| 3,335,902 | 8/1967 | Javorik | 220/673 |
| 3,397,820 | 8/1968 | Smith | 220/90.2 X |
| 3,474,844 | 10/1969 | Lindstrom et al. | 220/666 |
| 3,547,299 | 12/1970 | Kepple | 220/674 X |
| 3,547,308 | 12/1970 | Gilliem | 220/90.2 |
| 3,557,788 | 1/1971 | Swartz | 220/666 X |
| 4,090,635 | 5/1978 | Nelson et al. | 220/266 X |
| 4,167,234 | 9/1979 | Gordon et al. | 220/359 |
| 4,228,913 | 10/1980 | Mack et al. | 220/90.2 |
| 4,324,340 | 4/1982 | Belokin, Jr. | 220/906 X |
| 4,325,490 | 4/1982 | Conrad | 220/269 |
| 4,356,927 | 11/1982 | Cooper et al. | 220/90.2 |
| 4,403,709 | 9/1983 | Meins et al. | 220/90.4 |
| 4,415,097 | 11/1983 | Meins | 220/90.4 |
| 4,538,439 | 9/1985 | Frei | 220/673 X |
| 4,609,113 | 9/1986 | Seki | 220/906 X |
| 4,709,829 | 12/1987 | Johnson et al. | 220/90.2 |
| 4,775,564 | 10/1988 | Shriver et al. | 428/35 |
| 4,798,605 | 1/1989 | Steiner et al. | 222/83 X |
| 4,877,148 | 10/1989 | Larson et al. | 220/90.2 |
| 4,911,329 | 3/1990 | Canini | 222/81 |
| 4,953,706 | 9/1990 | Piccard | 222/81 X |

*Primary Examiner*—Stephen Marcus
*Assistant Examiner*—Stephen Cronin
*Attorney, Agent, or Firm*—Knobbe, Martens, Olson & Bear

[57] ABSTRACT

A partially collapsible container adapted to contain beverages or other dispensable fluids is disclosed in which the collapsible portion of the container provides for the automatic deployment of either a drinking straw or a pour spout mounted within the container. In its non-collapsed state, the straw or spout is hidden within the container; however, upon manual manipulation of the collapsible portion of the container, that portion comes into contact with the upper segment of the straw or spout, thereby causing the straw or spout to penetrate a weakened opening of the exterior surface of the container, thereby exposing the straw or spout for use. Also disclosed is a stopping mechanism to prevent the collapsed portion of the container from elastically springing back toward its original position.

8 Claims, 2 Drawing Sheets

PARTIALLY COLLAPSIBLE CONTAINER WITH DRINKING STRAW OR POUR SPOUT

BACKGROUND OF THE INVENTION

The present invention relates to a container for fluids which are easily dispensed, and, more particularly, to a container having a partially collapsible portion which, upon manual manipulation, reveals a drinking straw, funnel, or pour spout mounted within the container in order to conveniently dispense the fluids contained therein.

For many consumers, it is preferable to consume beverages from a container by means of a drinking straw. The use of a straw is generally considered a more sanitary form of beverage consumption. Furthermore, a straw is convenient and easy to use, and is usually a neater and cleaner method for drinking. That is, the fluid being consumed is less likely to be spilled if a straw is used because the container generally does not have to be tipped. This is especially true for young children who have difficulty, due to undeveloped motor skills, in drinking from a cup or container without the use of a straw. Accordingly, it is desirable for a large segment of the population to drink with a straw.

In order to meet this demand, there have been several attempts to mount a drinking straw inside of a container in a spring-loaded fashion. According to these attempts, when the container is open, the straw pops up for use by the consumer. However, such previous attempts have proven to be unreliable in that the straw did not actually pop-up as intended. Therefore, manufacturers of containers who wish to provide a drinking straw with each container usually mount the straw somewhere on the exterior of the container. While this allows the use of a straw, it is inconvenient to remove the straw from the exterior of the container and to insert it into the container; in addition, the mounting of the straw on the exterior of the container requires an additional packaging for the straw to keep it clean and some means for adhering the straw to the container. These problems increase manufacturing costs and the possibility of litter and debris.

Besides drinking, it is also preferable among many consumers to have a container with a funnel or pour spout incorporated into the container itself so that additional, separate utensils are not needed in order to dispense the contents of the container. This preference has also proven to be a challenge to container manufacturers.

SUMMARY OF THE INVENTION

The present invention easily solves the problems presented by the prior art by providing a partially collapsible container having a drinking straw, funnel, or pour spout incorporated within the container. When the container is collapsed in its intended fashion, the straw or spout is exposed for easy consumer use. Thus, rather than mechanically activating the straw within the can, the present invention simply and mechanically activates the container, while the straw remains essentially stationary. This is a much more reliable form of straw deployment and results in high consumer satisfaction.

According to one embodiment of the present invention, the upper portion of the fluid container is collapsible, preferably due to its construction at this location which is corrugated or accordion-like. The corrugation of the surface of the container at this location allows it to be manually collapsed by the consumer. Before use, the container is normally shaped, with most of the surface of the container being non-corrugated. This construction, including the collapsible portion, is rigid, thus allowing the container to be packaged with other similar containers and to be shipped and handled in the normal course of its distribution and sale without being prematurely collapsed.

In this embodiment, a drinking straw is mounted within the container and is arranged so that the upper end thereof is adjacent the collapsible portion of the container. The straw is rigidly mounted within the container by means of two or more mounting brackets extending from the container on the interior surface thereof. The top of the container is provided with a structurally weakened segment which eventually serves as an opening for the container. The weakened nature of the segment is provided, for example, by perforations or scoring of the container surface.

Upon use, the collapsible portion of the container is manually manipulated by the consumer to cause that portion to collapse. Some extra manual effort is required to overcome the initial structural rigidity of the container even at the corrugated location. Thereafter, however, the corrugations in the container permit that portion to be readily collapsed. As the container is collapsed, the weakened segment in the top of the container comes into contact with the upper portion of the drinking straw. Since the straw is rigidly mounted within the container and itself is constructed from a sufficiently rigid material, the upper portion of the straw penetrates the weakened portion on the top of the container and causes it to fail, automatically opening the container. The upper portion of the straw thereby becomes exposed on the exterior of the container and is ready for use by the consumer.

The drinking straw is also provided with a stopping mechanism to prevent the collapsible portion of the container from elastically springing back toward its original position. Such spring-back would cause the straw to be covered again by the container and to become unusable. The stopping mechanism is comprised of a plug-like device which is mounted on the upper portion of the straw or its mounting bracket and which engages the opening of the container in a friction fit. This engagement of the stopping mechanism and the opening on the top of the container holds the container down in its collapsed position.

In a second embodiment of the present invention, the drinking straw is replaced by a funnel or pour spout which is also rigidly mounted within the container and arranged so as to be adjacent the collapsible portion thereof. Thus, when the container is manually manipulated, the weakened opening on the top of the container engages the top of the funnel or pour spout and causes the opening to fail, thus opening the container. As the collapsible portion of the container is further collapsed by the consumer, the upper open portion of the funnel or pour spout is exposed for use. Again, as with the drinking straw, the funnel or pour spout is provided with a plug-like stopping mechanism (which can also comprise a collar mounted on the funnel or pour spout) for holding the collapsed portion of the container in its collapsed position.

It should be pointed out that the principles of the present invention apply to all types of containers having various configurations and materials. For example, these principles apply equally well to containers having circular, square, or rectangular, cross-sectional configurations. They also apply to a variety of container materials, such as aluminum, plastic, or cardboard paper.

Furthermore, the accordion-like construction of the collapsible portion of the container of the present invention can be located anywhere on a particular container. For example, the collapsible portion may be found on the bottom, sides, or center of the container, thus permitting deployment of a straw, funnel, or pour spout, from other locations within the container which permit the container to be used for other purposes, besides simply drinking or pouring. Moreover, the container of the present invention has applications in a number of industrial, consumer, and recreational settings, and should not be considered limited to the specific embodiments shown in the drawings or described herein.

DETAILED DESCRIPTION OF THE INVENTION

Figure 1:
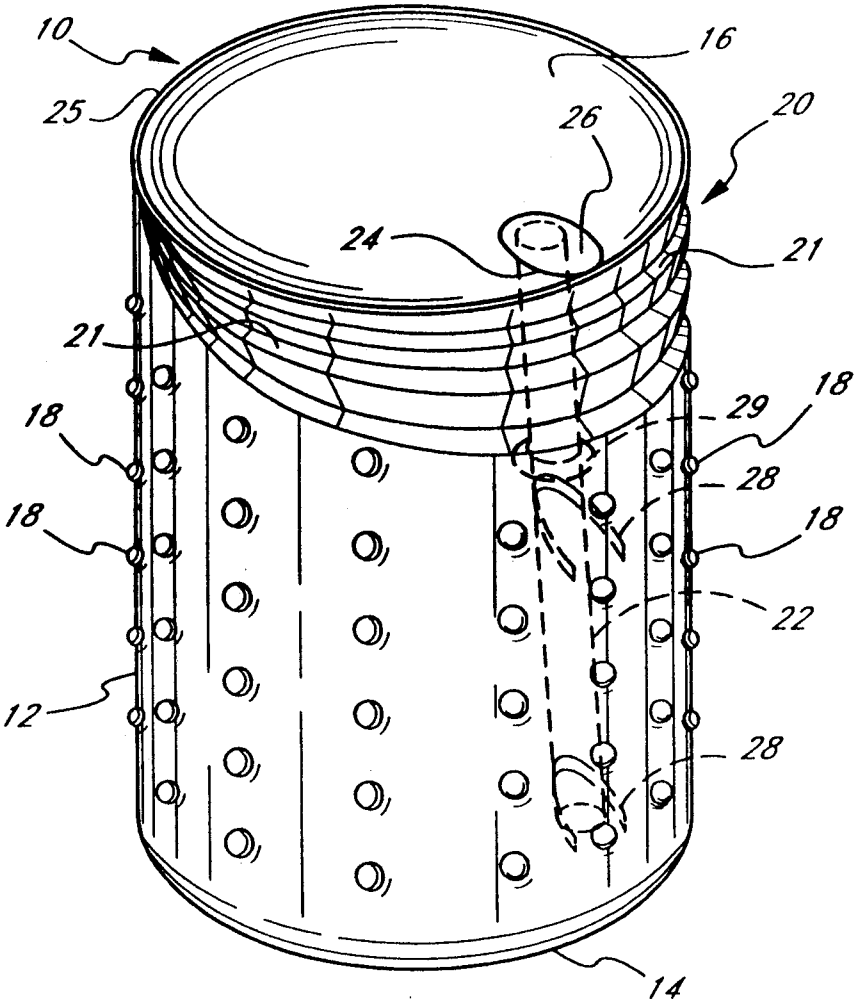
FIG. 1 is a perspective view of a container constructed in accordance with the principles of the present invention illustrating a corrugated, collapsible portion near the upper surface of the container.

Referring to FIG. 1, there is shown a container 10 constructed in accordance with the present invention, including an exterior cylindrical surface 12, a bottom surface 14 and a top surface 16. Although the invention is illustrated in connection with a cylindrical container, the principles of the present invention, as pointed out above, are equally applicable to containers of all configurations and dimensions, and should not be construed as being limited to those shown in the drawings. Also shown on the exterior surface of the container are raised nibs or other traction devices 18 which provide for an improved grip on the container 10, particularly when it is wet and cold. Such traction devices can also be easily provided with other shapes and configurations formed on the exterior of the container, such as stripes, squares, triangles, etc.

Figure 2:
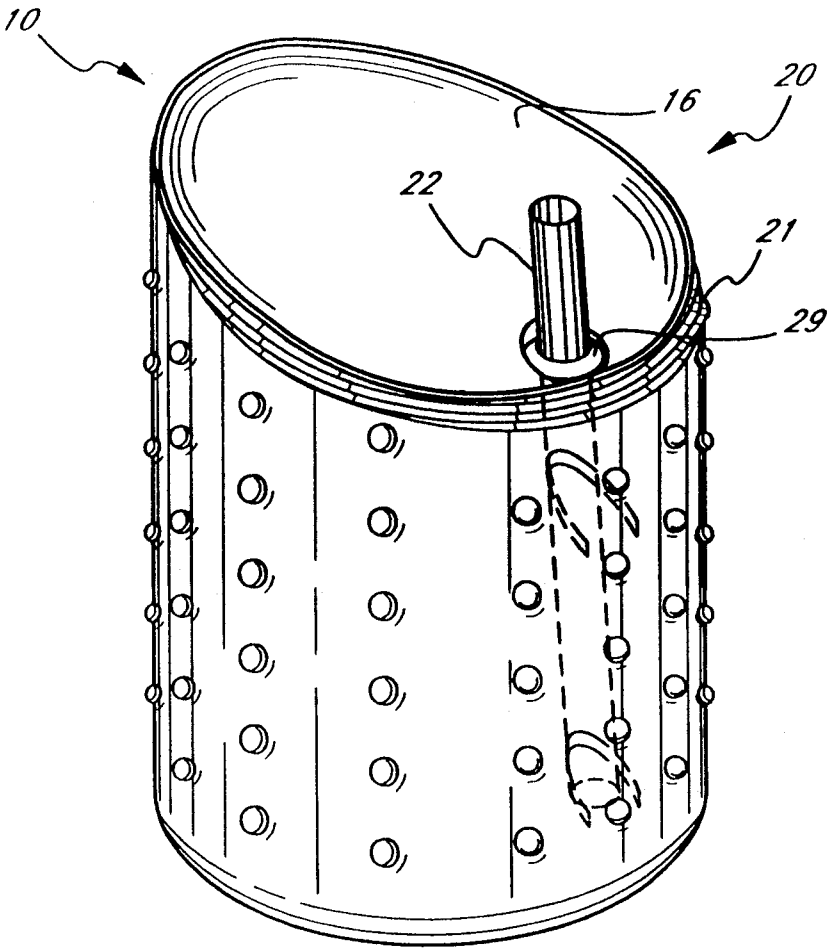
FIG. 2 is a perspective view of a container of the present invention in its collapsed state illustrating the exposure of a drinking straw for consumer use.

Shown in FIG. 1 is the collapsible portion 20 of the container 10 located near the top surface 16. This collapsible portion 20 of the container is that which can be manually manipulated by the consumer to reveal the drinking straw 22, shown in dotted lines in FIG. 1. The collapsibility of this portion 20 of the container 10 is provided by the nature of its construction in which it is structurally less rigid than the other portions of the container. This decreased rigidity can be provided in a number of ways, for example, by corrugating the surface of the container to be accordion-like, as shown in FIG. 1. Preferably, the corrugated portion 20 is arranged at a downward angle along one side of the container so that in its collapsed state, as shown in FIG. 2, the top surface of the container becomes inclined. This inclined nature of the corrugated portion 20 of the container 10 provides for structural rigidity along the non-corrugated side of the container, as shown in FIG. 1. This permits the container 10 of the present invention to be stacked, packaged and handled like other containers as is common in the beverage industry, without resulting in premature collapsing.

Shown on the top surface 16 of the container 10, as illustrated in FIG. is the opening 24 of the container. In the original construction of the container, the opening 24 is closed or sealed by a portion of material comprising a cover 26 having the same configuration as the opening 24. This cover 26 is attached to the opening 24 the container 10 by any means sufficient to cause a weakened state which can be readily penetrated. For example, the opening 24 can preferably be formed simply by perforating the top of the container in the configuration of the opening 24 so that the perforations weaken the attachment between the opening 24 and the cover 26 of the container.

The opening 24 is arranged so as to be adjacent the upper portion 26 of the drinking straw 22 which is mounted on the interior of the container 10. Preferably, the straw 22 is rigidly mounted to the interior surface of the container 10 by means of two or more mounting brackets 28, shown in FIG. 1. The straw 22 is itself constructed from a relatively rigid material so as to be capable of penetrating the weakened opening 24 on the top of the container.

In use, as illustrated in FIGS. 1 and 2, the consumer manually manipulates the corrugated side 20 of the container. Typically, the consumer would grasp the sides of the container with two hands and place both thumbs on the top of the container near the corrugated portion 20, but away from the opening 24. The thumbs could then be used to exert the manual pressure necessary to collapse the container. The opening 24 should be avoided so that the straw 22 can penetrate therethrough and become exposed without being interfered with by the hands of the consumer. A little extra manual force is required to overcome the initial rigidity provided by the corrugations of the container. Thereafter, the corrugations 21 permit the container to be readily collapsed in a downwardly inclined fashion, as illustrated in FIG. 1. As the collapsible portion 20 of the container moves downwardly, the upper portion of the straw 22 comes into contact with the weakened cover 26 of the opening 24, thus causing the cover to fail. The straw 22 then penetrates the opening 24 and becomes exposed. FIG. 2 illustrates the container of the present invention in its collapsed state in which the upper portion of the straw 22 is exposed beyond the top 16 of the container.

It should be pointed out that the inclined nature of the corrugations 21 of the container causes the collapsible portion 20 of the container to follow a slight arc along the radius defined by the diameter of the container. This means that, in order to ensure proper registration between the opening 24 of the container and the top of the straw 22, the straw 22 should be shifted slightly to one side of the center of the opening 24 to account for the arc that will be followed by the opening 24.

Figure 3:
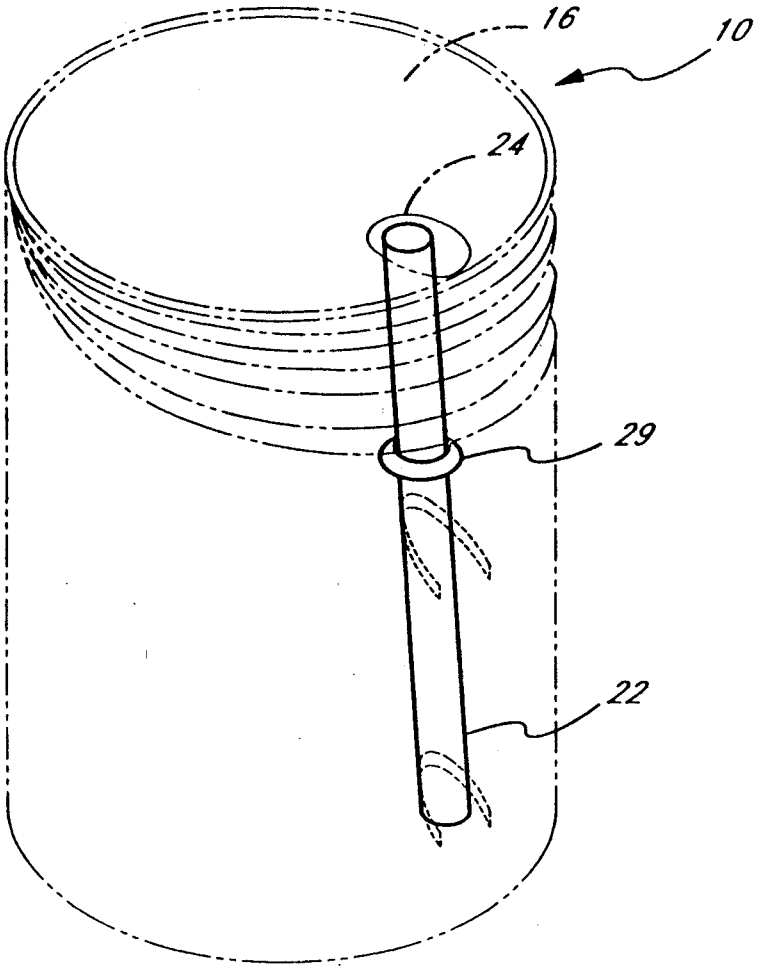
FIG. 3 is a perspective view of the drinking straw incorporated within the container of the present invention and further illustrating a stopping mechanism mounted near the upper portion thereof.

In another embodiment of the invention, shown in FIG. 3, the opening 24 can be simply elongated in order to come into direct contact with the top of the straw 22 as the opening 24 follows its arcuate path downwardly.

Yet another aspect of this invention would involve the use of horizontal corrugations (not shown) formed circumferentially around the entire container so that, in its collapsed state, the top 16 of the can remains horizontal or flat. This would permit placement of the opening 24 of the container directly above the top of the straw 22. In addition, the upper portion 26 of the straw may be angled slightly to meet the top of the container as it follows its downward arc. This angled portion (not shown) of the straw would also allow it to be more readily used by the consumer.

In order to prevent the collapsed portion 20 of the container from springing back upwardly toward its original position, the straw 22 is provided with a stopping mechanism illustrated in FIG. 3. The stopping mechanism is comprised of a collar 29 mounted around the straw 22 near its upper portion. When the straw 22 has penetrated the opening 24 of the container in order to expose the upper portion of the straw, the collar 29 shown in FIG. 3 engages the edges of the opening 24 in a friction-fit or press-fit relationship. This engagement causes the top of the container to be held in its collapsed position, as shown in FIG. 2. The collar 29 can be constructed from any suitable elastic material which can frictionally engage the edges of the opening 24. This stopping mechanism 29 can also be configured so as to substantially seal the opening 24.

Figure 4:
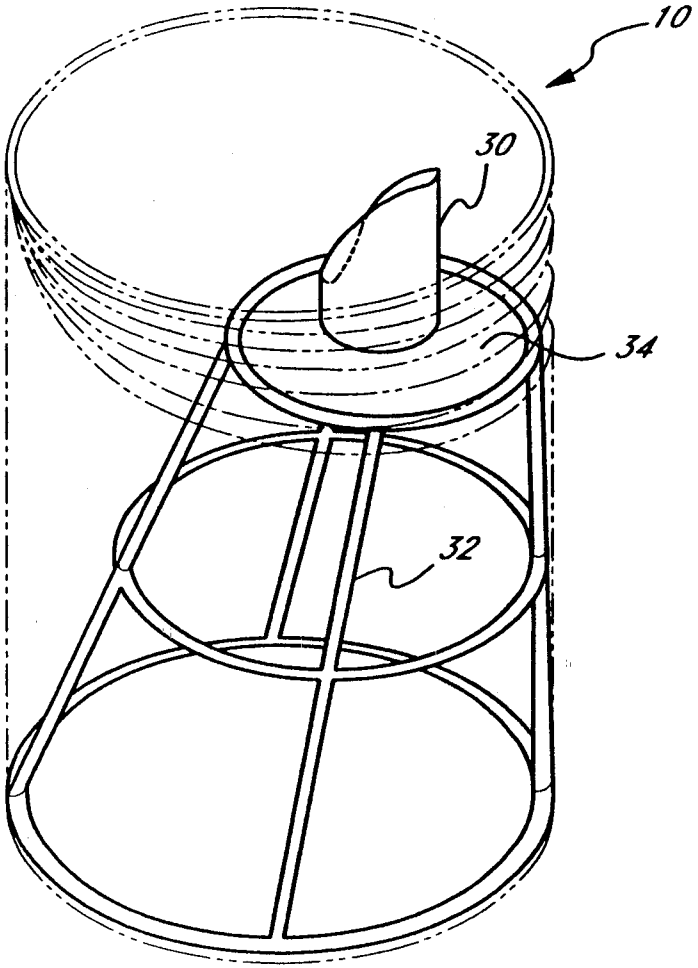
FIG. 4 is a perspective view of a funnel or pour spout device which can be mounted within the container of the present invention in the lieu of a drinking straw.

In another embodiment of the present invention, the drinking straw illustrated in FIGS. 1–3 can be replaced by a funnel or pour spout 30, which is illustrated in FIG. 4. Such a funnel or spout 30 can be utilized to dispense a wide variety of fluids, as well as other materials, for consumer or industrial use. In this embodiment, the funnel or spout 30 is mounted on a support frame 32 and is rigidly fixed within the container 10. As the container 10 is collapsed in the same fashion described above, the top of the funnel or spout comes into contact with the weakened opening (not shown) of the top of the container, thus causing the funnel or spout 30 to be exposed. The funnel or spout 30 is also provided with a collar or stopping mechanism 34 for holding the top of the container in its collapsed state.

It should also be pointed out in connection with this invention that the relative strength and rigidity of the container 10, its collapsible portion 20, and the opening 24 can be adjusted to accommodate different container materials and fluids. For example, if the container were to be constructed from a relatively non-rigid material, such as cardboard, it would be preferable that the opening be somewhat stronger so as to prevent premature opening of the container since the collapsed portion may be prematurely collapsed in shipping or handling. On the other hand, in certain applications, it may be preferable for the top portion of the straw 22 or spout 30 to form its own opening 24 by perforating the top surface 16 of the container 10 which surface is completely comprised of a weakened material such as paper or cellophane. Thus comment may not be necessary to have a discrete perforated opening 24, as described above.

In conclusion, the present invention provides a simple, yet reliable, method for deploying a drinking straw, funnel, pour spout or similar utensil from the interior of a fluid container. Furthermore, the container is easy to manufacture and simple to use.

What is claimed is:

1. A container, comprising:

a top surface having an aperture formed therein;

a selectively removable cover sealing said aperture;

a collapsible portion of said container adapted to collapse upon manual manipulation thereof; and a dispensing member located within said container for dispensing the contents of said container and adapted to engage said cover, penetrate said aperture and displace said cover from said aperture upon collapsing of said collapsible portion, thereby exposing a portion of aid dispensing member to permit the contents of aid container to be dispensed without manual manipulation of said dispensing member.

2. The container of claim 1, wherein said dispensing member is a straw.

3. The container of claim 1, wherein said dispensing member is a pour spout.

4. A container, comprising:

a body portion forming a cavity therewithin and having a collapsible portion and an aperture communicating through said body portion to said cavity for dispensing the contents of said container;

a selectively removable cover sealing said aperture; and a dispensing member mounted within said body portion of said container adapted so that collapsing said collapsible portion causes said dispensing member to engage said cover, penetrate said aperture and displace said cover, thereby exposing said dispensing member to permit the contents of said container to be dispensed.

5. A container for fluids, comprising:

a body portion enclosing a cavity for storing fluids, said body portion having:

a collapsible portion; and an aperture for dispensing fluids therethrough from said cavity;

a selectively removable cover sealing said aperture; and a dispensing member for easily dispensing fluids from said container, said dispensing member being located within said cavity of said body portion, and having:

a first portion substantially stationary and longitudinally fixed to said container; and a second portion aligned with said opening adapted so that manual manipulation of said collapsible portion causes said second portion of said dispensing member to engage said cover, penetrate said aperture and remove said cover from said aperture, thereby exposing said dispensing member to permit said fluids from said cavity to be dispensed through said dispensing member and said aperture.

6. The container of claim 5, further comprising means for keeping said collapsible portion of said container in its collapsed position and keeping said dispensing member exposed.

7. The container of claim 5, wherein said collapsible portion is partially collapsible and angled to one side of said container upon use.

8. A container, comprising:

a body portion having a collapsible portion and an aperture communicating through said body portion for dispensing the contents of said container;

a selectively removable cover sealing said aperture;

a dispensing member mounted within said body portion of said container adapted so that collapsing said collapsible portion causes said cover to be displaced thereby exposing said dispensing member;

wherein said collapsible portion consists of an integrated and corrugated surface; and wherein said collapsible portion collapses substantially to one side of said container.

* * * * *